US009073314B2

(12) United States Patent
Motala et al.

(10) Patent No.: US 9,073,314 B2
(45) **Date of Patent: *Jul. 7, 2015**

(54) BURST MODE ELECTROHYDRODYNAMIC PRINTING SYSTEM

(71) Applicant: Eastman Kodak Company, Rochester, NY (US)

(72) Inventors: Michael J. Motala, Rochester, NY (US); Giuseppe Farruggia, Webster, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/939,283

(22) Filed: Jul. 11, 2013

(65) Prior Publication Data

US 2015/0015629 A1 Jan. 15, 2015

(51) Int. Cl.

| | |
|---|---|
| ***B41J 2/06*** | (2006.01) |
| ***B41J 2/045*** | (2006.01) |
| ***B41J 2/385*** | (2006.01) |

(52) U.S. Cl.

CPC ..... *B41J 2/04588* (2013.01); *B41J 2/385* (2013.01); *B41J 2/06* (2013.01)

(58) Field of Classification Search

CPC ..... B41J 2/06
USPC ..... 347/55
See application file for complete search history.

(56) References Cited

U.S. PATENT DOCUMENTS

| | | | | |
|---|---|---|---|---|
| 3,893,131 | A * | 7/1975 | Perel et al. | 347/55 |
| 4,314,263 | A * | 2/1982 | Carley | 347/55 |
| 2002/0044173 | A1* | 4/2002 | Akase et al. | 347/55 |
| 2005/0116069 | A1* | 6/2005 | Murata | 239/690 |
| 2006/0139406 | A1* | 6/2006 | Tsuchiya et al. | 347/54 |
| 2010/0155496 | A1* | 6/2010 | Stark et al. | 239/3 |
| 2011/0134195 | A1 | 6/2011 | Kim et al. | |
| 2011/0187798 | A1* | 8/2011 | Rogers et al. | 347/55 |
| 2012/0105528 | A1 | 5/2012 | Alleyne et al. | |

OTHER PUBLICATIONS

Taylor, "Disintegration of Water Drops in an Electric Field", *Proceedings of the Royal Society of London, Series A, Mathematical and Physical Sciences*, vol. 280, 1964, pp. 383-397, published by The Royal Society.

Park et al., "High-Resolution Electrohydrodynamic Jet Printing", *Nature Materials*, vol. 6, 2007, pp. 782-789, published by Nature Publishing Group.

Mishra et al., "High-Speed and Drop-on-Demand Printing With a Pulsed Electrohydrodynamic Jet", *Journal of Micromechanics and Microengineering*, vol. 20, 2010, IOP Publishing.

* cited by examiner

*Primary Examiner* — Shelby Fidler
(74) *Attorney, Agent, or Firm* — William R. Zimmerli

(57) ABSTRACT

An electrohydrodynamic printing system includes a nozzle that dispenses a printing fluid and a substrate support. The nozzle includes a conductive portion. A voltage source applies a voltage differential between the conductive portion of the nozzle and the substrate support. A controller is configured to provide a burst mode waveform to the voltage source such that a drop of the printing fluid is caused to form from the conductive nozzle and travel toward the substrate support.

4 Claims, 9 Drawing Sheets

BURST MODE ELECTROHYDRODYNAMIC PRINTING SYSTEM

CROSS REFERENCE TO RELATED APPLICATIONS

Reference is made to commonly-assigned, U.S. patent application Ser. No. 13/939,249, entitled "BURST MODE ELECTROHYDRODYNAMIC PRINTING", filed concurrently herewith.

FIELD OF THE INVENTION

This invention relates generally to the field of fluid dispensers and, in particular, dispensers that produce a flow of liquid drops using electrohydrodynamic printing techniques and systems.

BACKGROUND OF THE INVENTION

Electrohydrodynamic jet (E-jet)printing uses electric-field induced fluid flows through micro capillary nozzles to cause a fine stream of drops to be formed and ejected. Typically, these electric fields are created by establishing a potential difference between the nozzle carrying the ink (the print head) and the receiving print substrate. A DC voltage is applied to the nozzle, causing the mobile ions in the ink to gather near the surface. This causes the meniscus at the nozzle tip to change into a conical shape, typically referred to as a Taylor cone, due to the tangential stress and attraction to the substrate. This is an unstable state that eventually results in a periodic drop release from the apex of the cone.

Other ways of forming a continuous stream of drops include drop-on-demand ink-jet printing using thermal and piezo-excitation and continuous inkjet printing using electrostatic or air deflection to direct the drops to a gutter or the receiver selectively. Among these, traditional ink jet printing systems are limited to low viscosity inks (say, less than 5 cP). Electrohydrodynamic jet printing has demonstrated superior resolution, printing of micron and sub-micron scale drops using a wide variety of inks. E-jet has been shown to work with fluids as high as 90 cP which makes it possible to use a much greater range of printing inks.

These developments are still inadequate, however, to open up a much greater range of applications to ink jet printing such as 3-D printing fluids and functional fluids whose viscosity is in the range of 15-100 cP or greater because the pulsed conditions lack sufficient control to print uniform drops (both in size and period between drops) in the kHz range.

Improved control of the drop formation of an E-jet system can be achieved by using a pulsed voltage on the capillary nozzle. In particular, control of the timing of the drop formation and the regularity of the drop size can be achieved by using a voltage profile, shown in FIG. 1 that has successive pulses at a fixed periodicity. This technique has proven effective with higher viscosity fluids in the sub kHz range, but not with consistent control of drop period and size in the kHz range. FIG. 2, adapted from High-speed and drop-on-demand printing with a pulsed electrohydrodynamic jet, S Mishra et al., J. Micromech. Microeng. 20 (2010), pages 1-8, shows the 1 kHz printing of Norland Optical Adhesive 74. The magnified edge of the image has an indeterminate period and drops size. It is unclear from the image what the true fundamental period that corresponds to the 1 kHz input is. The larger drops have a larger period. It does not appear as if the drops moved and merged on the surface, rather they are a result of missing every other print. This resulted in twice as larger of a drop at half the printing rate.

What is needed is a way to precisely control drop size and period with a range of higher viscosity fluids in the kHz range. Additionally, enhanced process controls to independently regulate process outputs such as drop size and delivery frequency also is desired.

SUMMARY OF THE INVENTION

According to another aspect of the invention, an electrohydrodynamic printing system includes a nozzle that dispenses a printing fluid and a substrate support. The nozzle includes a conductive portion. A voltage source applies a voltage differential between the conductive portion of the nozzle and the substrate support. A controller is configured to provide a burst mode waveform to the voltage source such that a drop of the printing fluid is caused to form from the conductive nozzle and travel toward the substrate support.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
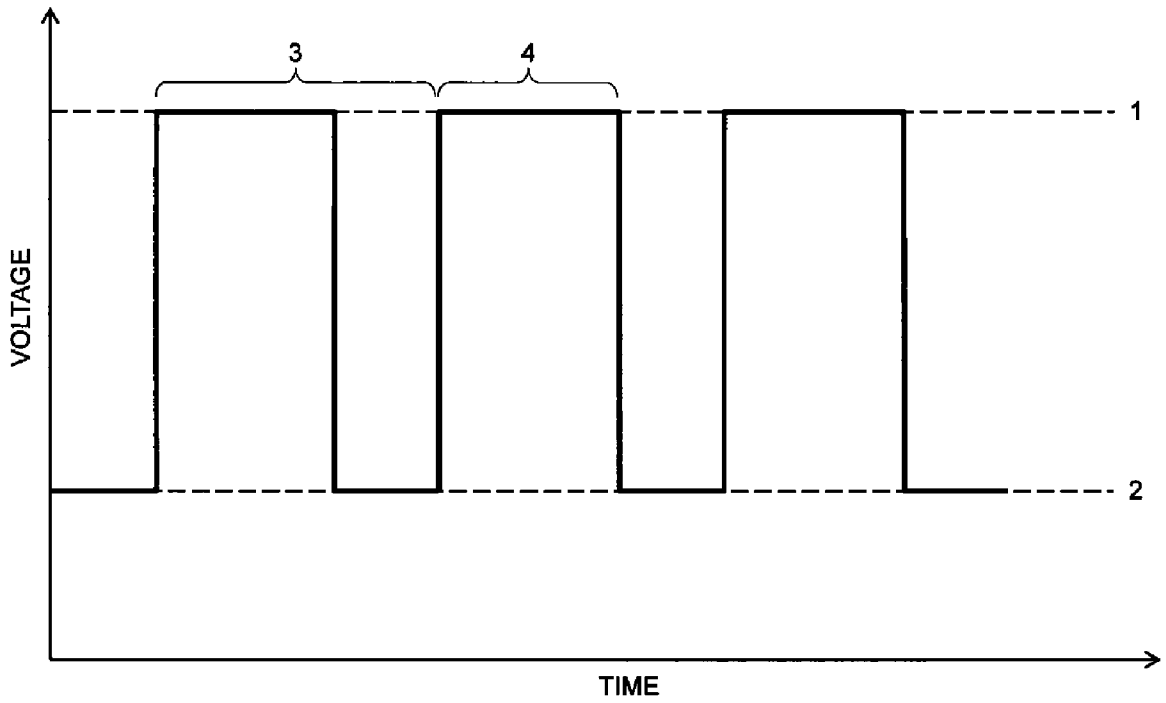
FIG. 1 (PRIOR ART)
FIG. 1 is a graph of a conventional waveform presently used for drop formation.
Figure 2:
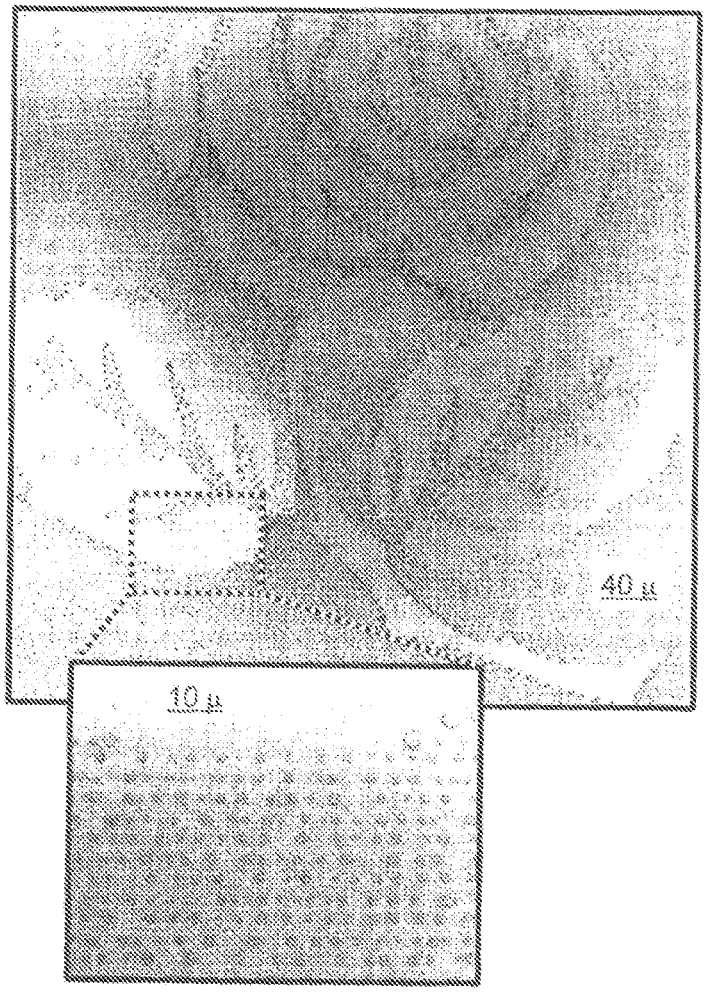
FIG. 2 (PRIOR ART)
FIG. 2 is a prior art image showing an example of a 1 kHz printed pattern of NOA 73 which has been adapted by removing its intermediate magnification.

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The example embodiments of the present invention are illustrated schematically and not to scale for the sake of clarity. One of ordinary skill in the art will be able to readily determine the specific size and interconnections of the elements of the example embodiments of the present invention.

Throughout the specification and claims, the following terms take the meanings explicitly associated herein, unless the context clearly dictates otherwise. The meaning of "a," "an," and "the" includes plural reference, the meaning of "in" includes "in" and "on." Additionally, directional terms such as "on", "over", "top", "bottom", "left", "right" are used with reference to the orientation of the Figure(s) being described. Because components of embodiments of the present invention can be positioned in a number of different orientations, the directional terminology is used for purposes of illustration only and is in no way limiting.

As described herein, the example embodiments of the present invention provide components typically used in inkjet printing systems. However, many other applications are emerging which use these components to emit liquids (other than inks) that need to be finely metered and deposited with high spatial precision. Such liquids include inks, both water based and solvent based, that include one or more dyes or pigments. These liquids also include various substrate coatings and treatments, various medicinal materials, and functional materials useful for forming, for example, various circuitry components or structural components. As such, as described herein, the terms "liquid" and "ink" refer to any material that is ejected by the system components described below.

Inkjet printing is commonly used for printing on paper. However, there are numerous other materials in which inkjet is appropriate. For example, vinyl sheets, plastic sheets, textiles, paperboard, and corrugated cardboard can comprise the print media. Additionally, although the term inkjet is often used to describe the printing process, the term jetting is also appropriate wherever ink or other liquids is applied in a consistent, metered fashion, particularly if the desired result is a thin layer or coating.

E-jet systems can be used to eject small drops of fluid using electrohydrodynamic forces. It has been found that under a sufficiently high constant applied potential difference drop are formed and ejected periodically as charges accumulate and relax with the ejection of a drop. In this case, drop size and frequency are determined by the viscosity, surface force, needle tip diameter, back pressure, and mobility of the ionic charge in the fluid. For printing there is a need to control the drop size and frequency of the drop ejection. Prior art practice has been to apply a pulsed potential difference as shown in FIG. 1. Such a waveform acts as a forcing function to provide some control over the drop parameters, volume and frequency. As shown in FIG. 1, the voltage amplitude, the difference between $V_{high}$ and $V_{low}$, 1 and 2, respectively, can be controlled and is typically chosen to provide acceptable drop formation. Too low of a difference, however, and drop formation is intermittent while too high of a difference can cause the drops to break up into a misty spray. In addition, the waveform period 3 can be specified thus controlling the drop frequency. The $V_{high}$ pulse width 4 also is controlled (PWM) to control the drop size, albeit over a limited range.

Figure 3:
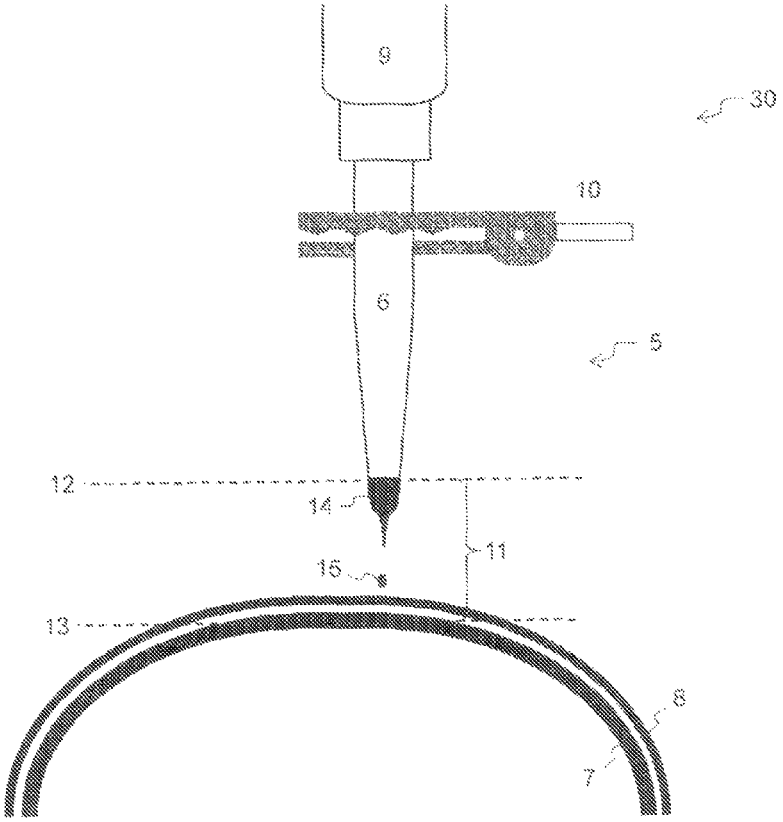
FIG. 3 is a schematic view of an E-jet printing system made in accordance with an example embodiment of the present invention including an E-jet ejector apparatus.
Figure 4:
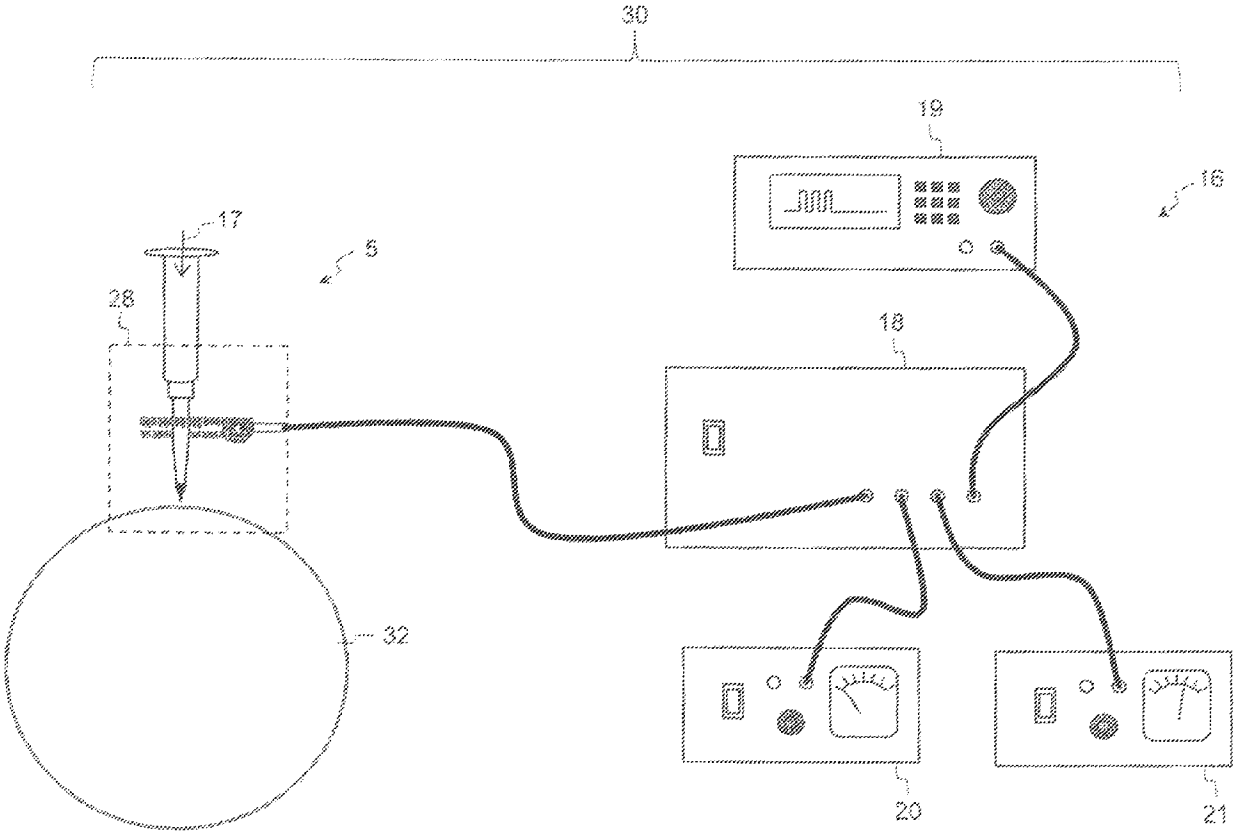
FIG. 4 is a schematic view of the E-jet printing system shown in FIG. 2 including an E-jet waveform control system and the E-jet ejector apparatus.

An example embodiment of an E-jet deposition system 30 for e-jet printing is shown in FIGS. 3 and 4. FIG. 3 shows an E-jet ejector apparatus 5. E-jet ejector apparatus 5 includes a nozzle 6, a grounded surface 7, a liquid reservoir 9, and a high voltage connection 10. The potential difference is applied between the nozzle 6 and the grounded surface 7. The actual electric field is determined by the separation gap between the electrode and ground, in the case of a conductive nozzle it is the distance 11 between the nozzle tip 12 and the closest approach 13 of the ground 7 to the nozzle 12. Alternatively, an electrode can be threaded inside a nonconductive nozzle. In this latter case the potential difference would be between the base of the electrode and the grounded surface. When the potential difference is applied and the ions flow in the liquid supplied by the liquid reservoir 9, for example, a conductive liquid or ink, a Taylor cone 14 is formed and drops 15 are formed and ejected. Once formed, the drops 15 fall and make contact to a receiving substrate 8.

FIG. 4 shows the E-jet ejector apparatus 5 and the E-jet control apparatus 16 of the E-jet deposition system 30. In order to maintain a steady production of drops, liquid is supplied to the nozzle 6 by a liquid source that includes a constant back pressure 17. The back pressure is supplied by the house compressed air line. The pressure assists with replenishing material depleted at the Taylor cone, it is not sufficient to jet the ink on its own. The high voltage is delivered by an in-house built and designed high voltage, high frequency switch 18. The output of switch 18 is controlled by a waveform generator 19 and is switched between a low voltage rail 20 and a high voltage rail 21. The switch 18 is designed to operate at frequencies up to and including 0.5 MHz and up to and including 1800V can be applied to the switch 18 from the high voltage rail 21. MHz resolution is required to resolve individual pulse widths of a bust sequences where the individual peak widths can be in tens of nanosecond range.

System 30 includes a substrate support mechanism 38. The relative location of the nozzle 6 and the receiving substrate 8 is controlled during a drop dispensing or deposition operation. A substrate conveyance mechanism 32, a nozzle conveyance mechanism 28, or a combination of both can be used to accomplish relative movement during deposition. In some example embodiments, the substrate support mechanism 38 also moves the substrate during the deposition operation. One example of a substrate conveyance mechanism 32 includes a rotating drum or an x-y translation table. One example of a nozzle conveyance mechanism 28 includes a linear motor that moves the nozzle in one direction or a plurality of motors configured to move the nozzle in more than one direction. As shown in FIG. 4, the receiving substrate 8 is positioned on a rotating drum 32 and a linear motor 28 translates the nozzle 6 back and forth across the receiving substrate 8. Other conventional substrate conveyance mechanisms or nozzle conveyance mechanisms can be used to control the relative location of the nozzle 6 and the receiving substrate 8 during the drop dispensing or deposition operation. Drop spacing is determined by the rotation speed of the drum 32 on which the substrate is affixed, the amount of translation of the nozzle 6, or a combination thereof.

Figure 5:
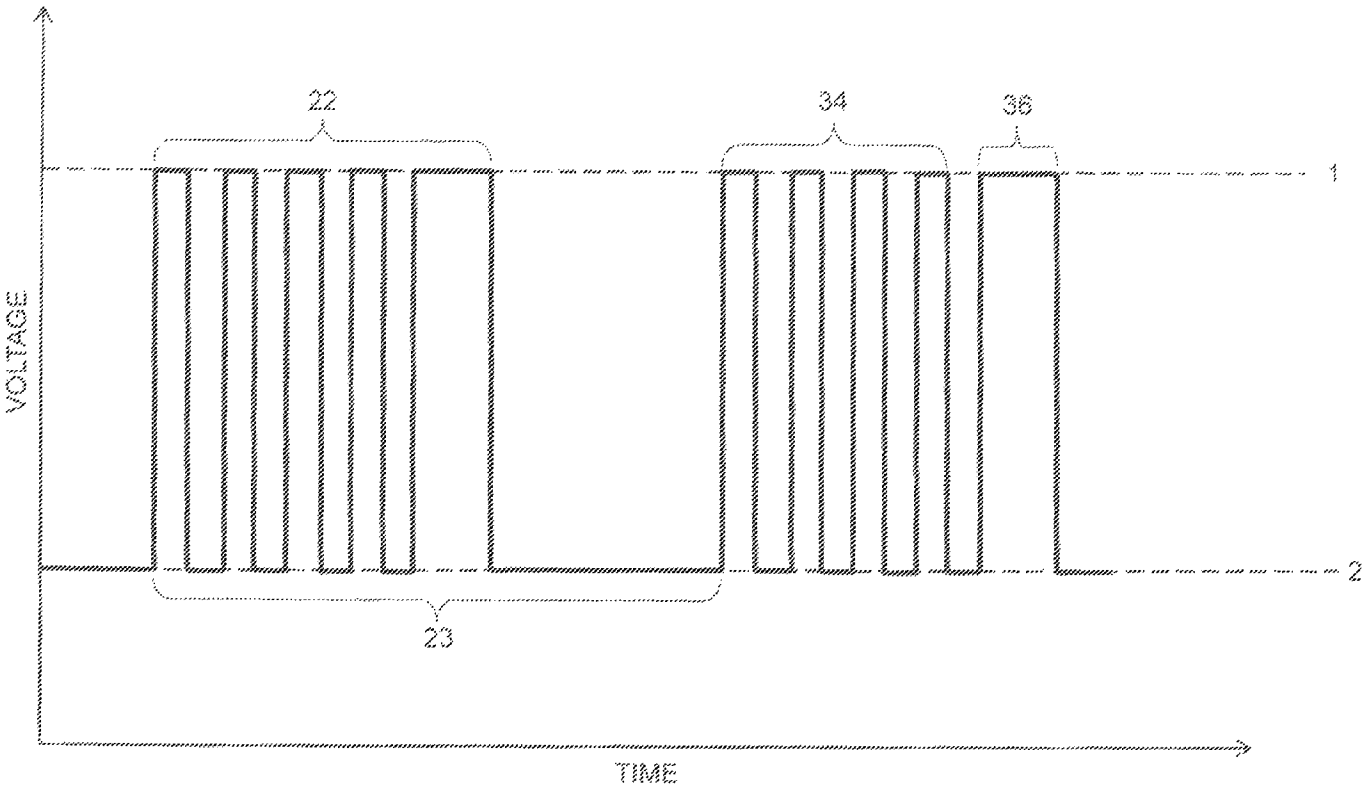
FIG. 5 a graph of a burst mode waveform according to a first example embodiment of present invention.

A first example embodiment of a waveform of the present invention is shown in FIG. 5. It has been found that this waveform provides improved control of drop formation when compared to conventional waveforms. With this pulse sequence a steady stream of drops with uniform period and size are reproducibly generated. The waveform includes a burst 22 that includes a plurality, for example, a series, of smaller pulses 34. Each of the pulses of the burst 22 takes place within an operational period 23. The length of the burst 22 can be changed by a multiplication factor to either fill more or less of the time of the period 23. The period 23 defines the desired drop generation rate. $V_{high}$ 1 and $V_{low}$ 2 are defined in the same manner as was described with reference to FIG. 1. The number of peaks, the peak widths, and the values of $V_{high}$ 1 and $V_{low}$ 2 are typically optimized to generate one drop within the given frequency 23. The pulse widths 34 of the individual pulses can also be independently defined. The burst 22 waveform also includes one larger pulse 36 that follows the plurality of smaller pulses 34. The sizes of pulses 34 and 36 are relative to each other and the pulse width 36 of the individual pulse can also be independently defined. As shown in FIG. 4, burst 22 includes five, smaller, pulses 34 with the final pulse of the burst sequence defined by one larger pulse width 36. For a given operational frequency 23 there are different combinations, through changing the number of peaks, peak widths, and $V_{high}$ 1 and $V_{low}$ 2, that can yield the same print result. The combination selected usually depends on the specific contemplated.

Figure 6:
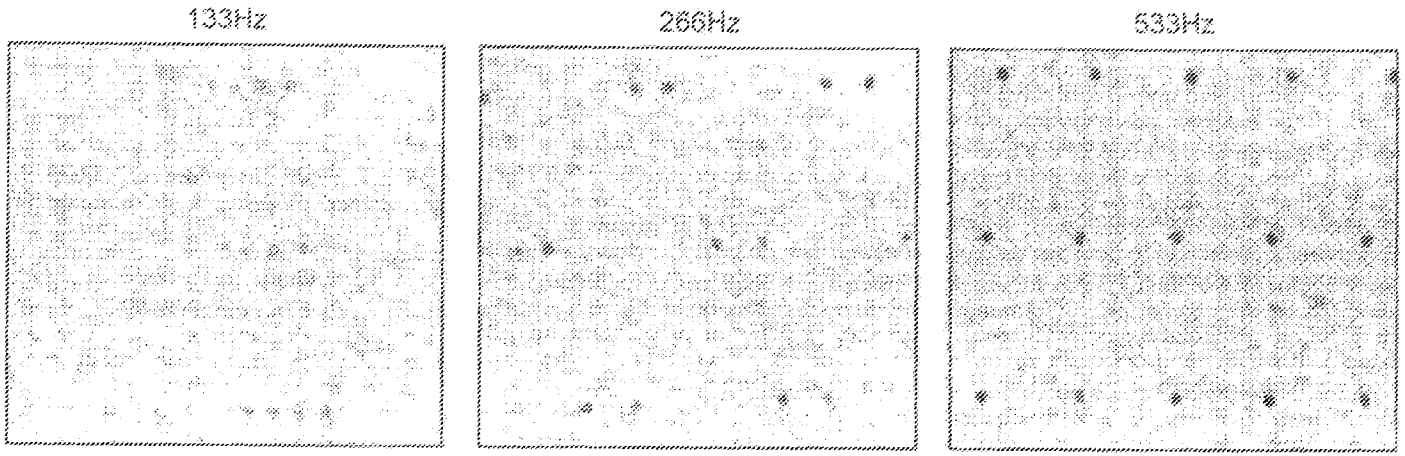
FIG. 6 shows three images of drops produced with the waveform of FIG. 5, in each image the frequency is doubled while maintaining constant energy.

FIG. 6 shows three different examples of printed dots of Norland Optical Adhesive 74 (NOA 74) on thermal paper using the burst waveform shown in FIG. 5. At 25° C., the test fluid NOA74 had a measured viscosity of ~120 cps. Thermal paper was selected as the receiving substrate both because it is thin (thin support act as less of a capacitor, allowing for the tip to better sense the under-laying ground), and because NOA chemically reacts with the papers by turning dark upon UV curing, allowing for direct imaging of an otherwise transparent material. Other substrates were tested but this combination was preferred because direct imaging of the NOA on the surface was possible. It should be noted that the thermal paper causes large spreading of the printed material. The drops in-flight are of smaller diameters and printing onto appropriately surface treated receiving substrates will result in a significant reduction of the print drop diameter. The drops in FIG. 6 were printed with a burst 22 that filled ⅓ of the period 23. The burst included 5 pulses with a variable operating frequency. The first 4 pulses in this example are identical and the last is 50% longer. The final pulse does not have to be larger but was found to be beneficial in assisting with drop break off. In each image of FIG. 6 the operational frequency is doubled. Doubling the frequency cuts the widths of the pulses within the burst in half (constant percent duty); however the total energy is maintained because there are now twice as many busts within the same time frame. FIG. 6 is important in highlighting the effectiveness of the bust sequence. At 133 Hz groups of 4 drops are generated for each burst, successive doubling of the frequency to 266 and again to 533 reduces the number to two and finally one drop per period, respectively. The length of the period (distance between a single drops or the distance between repeating groups of drops for the case of multiple drops generated) is also cut in half for each doubling of the frequency. The print volume is roughly constant; this is primarily controlled by the pack pressure (constant feed rate of material). In all cases multiple waveforms within a single burst are needed to generate a print drop. Drop spacing was determined by the rotation speed of the drum 32 to which the print media was attached.

Figure 7:
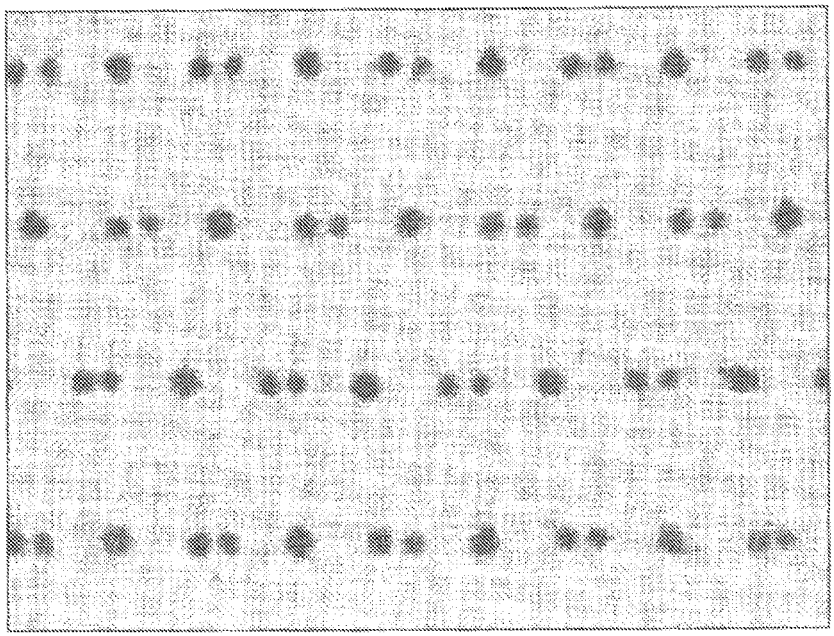
FIG. 7 is an image of drops produced at 5.0 kHz with a 120 cP material using the waveform of FIG. 5.

FIG. 7 shows that controlled uniform printing of NOA 74 is possible in the kHz range utilizing a burst sequence. The drops, as with FIG. 7, were printed with a burst 22 that filled ⅓ of the period 23. The burst included 5 pulses with an operating frequency of 5.0 kHz. The first 4 pulses are identical and the last is 50% longer. Drops were printed with a 10 μm I.D. nozzle and measured 71±4 μm on the thermal paper. The printing optimization is dependent upon the material. Factors including viscosity, surface tension, conductivity, and shear thinning, require unique waveform optimization per material. Higher printing rates with a 10 μm inner diameter nozzle diameter have been demonstrated. The print frequency can be further increased by reducing the inner nozzle diameter. Typically a 10 μm inner diameter nozzle was used because this is a size range that is generally accepted in inkjet printing nozzle heads as a diameter where the likelihood of nozzle clogging is minimal. This technique is ideally suited for drop formation with materials with a viscosity range of 4-200 cP but not inclusive. Lower viscosities materials can be printed. Materials at the other extreme (200-1000+ cP) have been tested but drop breakup, though while possible, requires more energy and the maximum printing rate drops when compared to the printing rate of a lower viscosity material.

Figure 8:
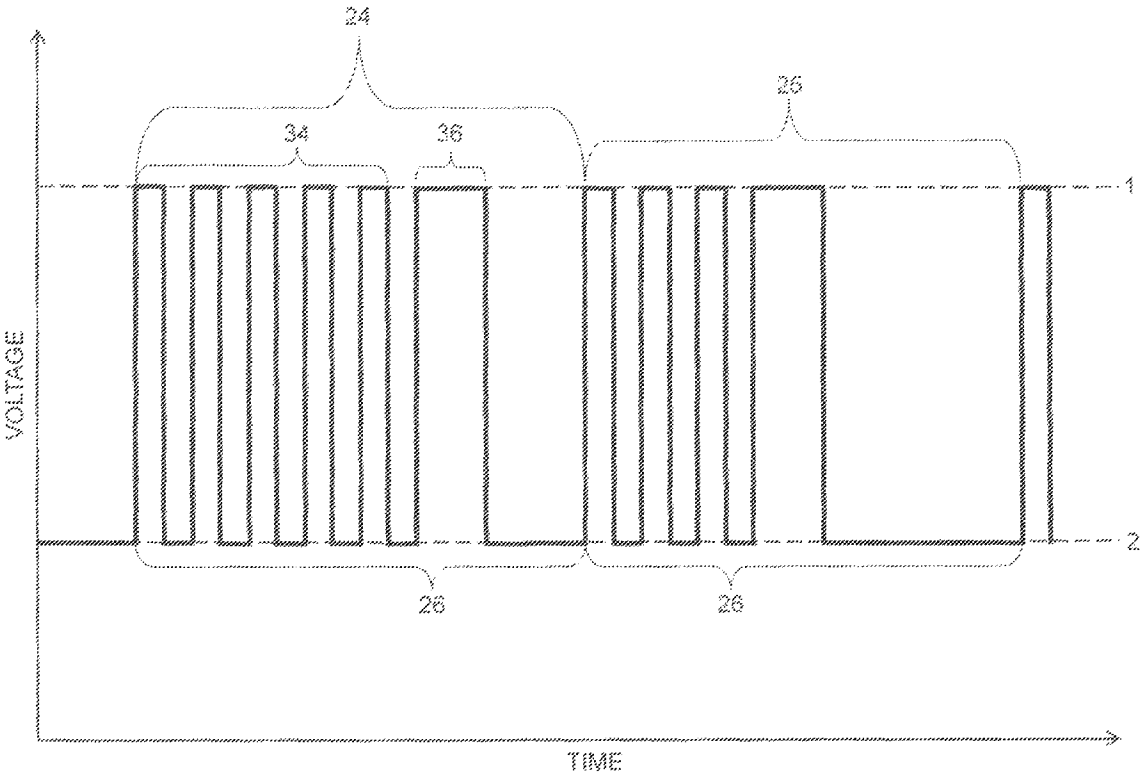
FIG. 8 is a graph of a burst mode waveform according to a first example embodiment of present invention.

A second embodiment of a waveform of the present invention is shown in FIG. 8. When compared to convention waveforms, this waveform provides improved control of the size and number of drops formed by varying the pulse burst. As shown, two differing burst waveforms 24 and 25 are provided in an alternating manner to form a single large drop and two smaller drops per sequence in FIG. 9. Each pulse burst 24 and 25 takes place over a constant period 26. $V_{high}$ 1 and $V_{low}$ 2 are defined in the same manner as was described with reference to FIG. 1.

The first burst 24 includes a plurality, for example, a series, of smaller pulses 34. Each of the pulses of the burst 24 takes place within the operational period 26. The length of the burst 24 can be changed by a multiplication factor to either fill more or less of the time of the period 26. The period 26 defines the desired drop generation rate. The number of peaks, the peak widths, and the values of $V_{high}$ 1 and $V_{low}$ 2 are typically optimized to generate one drop within the given frequency 26. The pulse widths 34 of the individual pulses can also be independently defined. The burst 24 waveform also includes one larger pulse 36 that follows the plurality of smaller pulses 34. The sizes of pulses 34 and 36 are relative to each other and the pulse width 36 of the individual pulse can also be independently defined. As shown in FIG. 8, burst 24 includes five, smaller, pulses 34 with the final pulse of the burst sequence defined by one larger pulse width 36. For a given operational frequency 26 there are different combinations, through changing the number of peaks, peak widths, and $V_{high}$ 1 and $V_{low}$ 2, that can yield the same print result. The combination selected usually depends on the specific contemplated.

Figure 9:
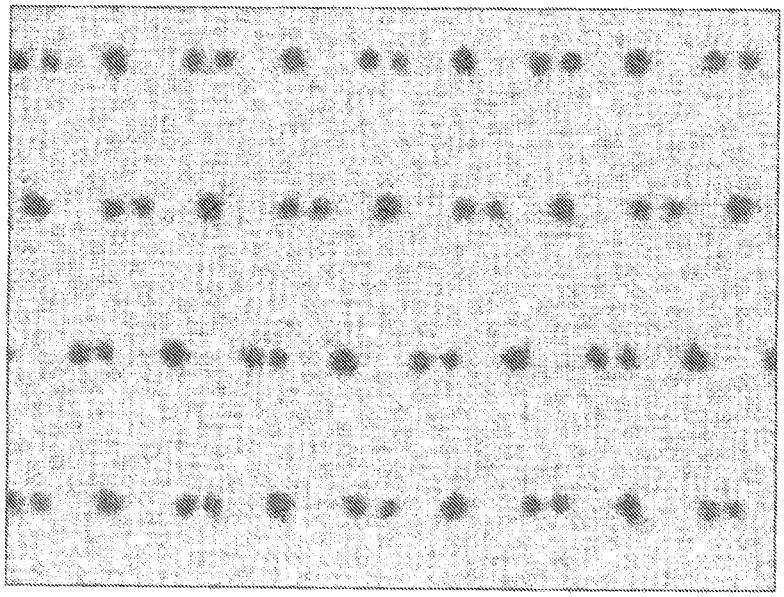
FIG. 9 is an image of drops produced using the waveform of FIG. 7.

The second burst 25 includes a plurality, for example, a series, of smaller pulses 34. Each of the pulses of the burst 25 takes place within the operational period 26. The length of the burst 25 can be changed by a multiplication factor to either fill more or less of the time of the period 25. The period 26 defines the desired drop generation rate. The number of peaks, the peak widths, and the values of $V_{high}$ 1 and $V_{low}$ 2 are typically optimized to generate one drop within the given frequency 26. This is not the case in FIG. 9. In FIG. 9, because two differing sized drops were desired, two drops were generated within the frequency 26. The pulse widths 34 of the individual pulses can also be independently defined. The burst 25 waveform also includes one larger pulse 36 that follows the plurality of smaller pulses 34. The sizes of pulses 34 and 36 are relative to each other and the pulse width 36 of the individual pulse can also be independently defined. As shown in FIG. 8, burst 25 includes three, smaller, pulses 34 with the final pulse of the burst sequence defined by one larger pulse width 36. For a given operational frequency 26 there are different combinations, through changing the number of peaks, peak widths, and $V_{high}$ 1 and $V_{low}$ 2, that can yield the same print result. The combination selected usually depends on the specific contemplated.

FIG. 9 shows an example of printed dots of NOA 74 on thermal paper using the waveform shown in FIG. 8. The first burst 24 included six pulses and the second burst 25 included four pulses. The net operation frequency was 500 Hz, 1.0 kHz for each burst 24 and 25. At 25° C., NOA74 was measured to have viscosity of ~120 cP. Drops were printed with a 10 μm I.D. nozzle and measured 71±4 μm on the thermal paper. The large drop was formed by burst waveform 24 and the pair of smaller drops was formed by burst waveform 25. Drop spacing was determined by the rotation speed of the drum 32 on which the receiving substrate was positioned. The net spacing of the repeating pattern is consistent for a 500 Hz period. The conditions of each individual burst 24 and 25 are stable as long as a constant volume of liquid is ejected between each burst. Depending on the application contemplated, the large and small drops shown in FIG. 9 can be thought of as print drops and catch drops with the catch drops being collected using a conventional deflection and catcher technology. Alternatively, both the large and small drops can be used to create the image or pattern on the substrate By way of background, the liquid is supplied to the nozzle having an inner diameter, D. The shape of the liquid on the nozzle tip is defined by the material's surface tension. A back pressure feeds the material. This pressure, however, is not sufficient to impart a velocity to the fluid. In the absence of external stimuli (voltage) the material will ooze out of the nozzle. When the pulses are applied to the stimulation device charge is added to the material. Charge buildup leads to perturbation of the material at the nozzle tip. The tip deformation is known as a Taylor cone and the charge buildup moves the material with a velocity V that is material dependant. As the material elongates, eventually a threshold will be reached at which point a charged drop will separate from the Taylor cone. On the other hand, if the charge stops building it will not cause a drop to break off from the Taylor cone.

Referring back to FIGS. 4-9, generally described, the present invention provides improved control of drop formation, drop size, or drop numbers by the introduction of a higher frequency burst of stimulations pulses during the time interval that is to form a drop. Comparing FIG. 5 or FIG. 8 to FIG. 1, one sees that the single large pulse in FIG. 1 has been replaced by a series of smaller, or narrow, pulses followed by a single larger pulse. The time period between each "burst mode" pulse and energy is sufficiently low that these individual pulses don't induce drop break off.

In accordance with the present invention, FIGS. 5 and 8 show examples pulse configurations that can be used to generate either drops of the same size or drops of different sizes. One skilled in the art will recognize and understand that any number of drops can be formed in succession.

The burst pulses, the closely spaced pulses in FIGS. 4 and 6, have the same duty cycle as the other pulses shown in each figure, respectively, but only one-half the period. Therefore, the burst pulses are generated at twice the frequency as the other pulses. The burst pulses do, however, have an effect on the drop generation, as shown in FIGS. 7 and 9. In accordance with this example embodiment of the invention, the last pulse in the burst of pulses has a larger duty cycle than the other pulses in the burst of pulses but is not a necessary requirement.

There are several differences to note between the drops generated by the standard waveform shown in FIG. 1 and the burst waveforms shown in FIGS. 5 and 8. The burst waveform shown in FIG. 6 has benefits including, for example, a more energy efficient manor to generate drops; allows for a larger portion of the total waveform to be populated; and, at higher frequencies, it allows for a more distributed energy within the period.

The invention has been described in detail with particular reference to certain example embodiments thereof, but it will be understood that variations and modifications can be effected within the scope of the invention. Even though specific embodiments of the invention have been described herein, it should be noted that the application is not limited to these embodiments. In particular, any features described with respect to one embodiment may also be used in other embodiments, where compatible. The features of the different embodiments can be exchanged, where compatible.

PARTS LIST

1 the voltage amplitude $V_{high}$
2 the voltage amplitude $V_{low}$
3 the waveform period
4 the $V_{high}$ pulse width
5 the E-jet ejector apparatus
6 the conductive nozzle
7 the grounded surface
8 the receiving substrate
9 the ink reservoir
10 the high voltage connection
11 the separation gap
12 the nozzle tip
13 the closest approach of the ground to the nozzle
14 the Taylor cone
15 ejected drops
16 the E-jet control apparatus
17 constant back pressure
18 high frequency, high voltage switch
19 waveform generator
20 low voltage rail
21 high voltage rail
22 burst waveform
23 burst waveform operational period
24 first drop size burst waveform
25 second drop size burst waveform
26 burst waveform operational period
28 a nozzle conveyance mechanism, for example, a linear motor
30 the E-jet deposition system
32 substrate conveyance mechanism, for example, a rotating drum
34 small pulse(s)
36 large pulse(s)
38 substrate support mechanism

The invention claimed is:

1. An electrohydrodynamic printing system comprising:
a nozzle that dispenses a printing fluid, the nozzle including a conductive portion;
a substrate support;
a voltage source that applies a voltage differential between the conductive portion of the nozzle and the substrate support; and
a controller being configured to provide a first burst mode waveform to the voltage source such that a singular first drop of the printing fluid having a volume is caused to form from the conductive nozzle and travel toward the substrate support, the controller being configured to provide a second burst mode waveform to the voltage source to cause a plurality of second drops of the printing fluid to form from the conductive nozzle, wherein the first burst mode waveform and the second burst mode waveform have the same period, and a different number of small width pulses, the singular first drop and the plurality of second drops having different sizes when compared to each other, the plurality of second drops having the same volume as the singular first drop.

2. The system of claim 1, the printing fluid being a high viscosity liquid, further comprising:
a liquid source that provides the printing fluid to the nozzle.

3. The system of claim 2, wherein the liquid source provides the printing fluid to the conductive nozzle at a constant pressure.

4. The system of claim 1, wherein the first and second burst mode waveforms comprise a series of small width pulses followed by a large width pulse, wherein each small width pulse is not sufficient to cause drop formation by itself.

* * * * *